US006776353B2

(12) United States Patent
Moorthy et al.

(10) Patent No.: US 6,776,353 B2
(45) Date of Patent: Aug. 17, 2004

(54) FUEL INJECTOR VALVE SEAT ASSEMBLY WITH RADIALLY OUTWARD LEADING FUEL FLOW PASSAGES FEEDING MULTI-HOLE ORIFICE DISK

(75) Inventors: Jayashree Moorthy, Yorktown, VA (US); Wei-Min Ren, Niskayuna, NY (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 84 days.

(21) Appl. No.: 10/015,941

(22) Filed: Dec. 17, 2001

(65) Prior Publication Data

US 2003/0111544 A1 Jun. 19, 2003

(51) Int. Cl.[7] ..... F02D 7/00; F02M 63/00

(52) U.S. Cl. ..... 239/5; 239/533.2; 239/533.3; 239/533.12; 239/533.14; 239/596

(58) Field of Search ..... 239/533.2, 533.3, 239/533.9, 533.11, 533.12, 533.14, 585.1, 596, 5

(56) References Cited

U.S. PATENT DOCUMENTS 4,416,423 A 11/1983 Krauss et al. ..... 239/585
4,532,906 A 8/1985 Höppel ..... 123/470
4,650,122 A 3/1987 Kienzle et al. ..... 239/497
4,907,748 A * 3/1990 Gardner et al. ..... 239/584
5,484,108 A * 1/1996 Nally ..... 239/585.4
5,516,047 A 5/1996 Kubach et al. ..... 239/585.5
5,540,200 A 7/1996 Naitoh et al. ..... 123/299
5,586,726 A 12/1996 Furuya et al. ..... 239/533.12
5,685,491 A * 11/1997 Marks et al. ..... 239/585.3
5,746,376 A 5/1998 Romann et al. ..... 239/585.4
6,357,677 B1 * 3/2002 Ren et al. ..... 239/585.4

* cited by examiner

*Primary Examiner*—Robin O. Evans

(57) ABSTRACT

A fuel injector for use in a fuel injection system of an internal combustion engine that includes a body, valve seat, closure member, orifice plate and metering device. The closure member and the valve seat define a sealing surface, located on a virtual circle defining a sealing diameter. The orifice plate includes a third surface, a fourth surface and at least one orifice, located on a virtual circle on the orifice plate defining a first radius and between the third and fourth surfaces. The metering device has first and second faces contiguous to a third face. At least one of the first and third faces are spaced from one of the first and second surfaces of the valve seat to define a plurality of passages. Each passage has an outlet located on a virtual circle defining a second diameter greater than at least one of the first and the sealing diameters.

23 Claims, 5 Drawing Sheets

FUEL INJECTOR VALVE SEAT ASSEMBLY WITH RADIALLY OUTWARD LEADING FUEL FLOW PASSAGES FEEDING MULTI-HOLE ORIFICE DISK

FIELD OF THE INVENTION

This invention relates to a fuel injector valve seat assembly in general, and more particularly, to a fuel injector valve seat assembly with radially outward leading fuel flow passages feeding a multi-hole orifice disk.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The precise metering and atomization of the fuel reduces combustion emissions and increases the fuel efficiency of the engine.

An electro-magnetic fuel injector typically utilizes a solenoid assembly to supply an actuating force to a fuel metering valve. Typically, the fuel metering valve is a plunger-style needle valve which reciprocates between a closed position, where the needle is seated in a valve seat to prevent fuel from escaping through a metering orifice into the combustion chamber, and an open position, where the needle is lifted from the valve seat, allowing fuel to discharge through the metering orifice for introduction into the combustion chamber.

Typically, a volumetric chamber or sac exists downstream from the discharge tip of the needle and upstream of the orifice. Upon seating of the needle on the valve seat, a volume of fuel, in liquid form, remains within the sac volume, typically during low manifold pressure, at low or ambient tip temperature operating conditions such as during a cold-start. At high temperature, such as during a hot-start, this volume of fuel tends to be in vapor form which leads to difficult starting as this volume would cause the fuel mixture to be richer than anticipated by a fuel injection controller during such a hot-starting operation. Similarly, during a hot shut-down, some of the fuel, however, remains in the sac which vaporizes due to heat soak and causes evaporative emissions which are undesirable. Thus, in order to minimize the amount of fuel in the sac volume that can be vaporized between hot and cold starts, it is believed that this sac volume should be minimized.

It is believed that some existing fuel injectors employ a valve seat assembly with a centerline through-hole that feeds directly to an orifice disk via a fairly large sac volume. In addition to the disadvantages described above, it is believed that this large sac volume creates vortices. The growth and decay of both inner and outer vortices result in spray instability, which is detrimental to spray definition, i.e., targeting. Furthermore, the existing single centerline through-hole limits the size of a diameter of a bolt circle. Thus, it is believed that a fuel injector valve seat assembly is needed that can control delivery of fuel while maintaining current sealing diameters, minimizing sac volume, and eliminating vortex generation.

SUMMARY OF THE INVENTION

The present invention provides a fuel injector for use in a fuel injection system of an internal combustion engine that minimizes sac volume and tends to reduce undesirable vortices in the flow of fuel. In one preferred embodiment of the invention, the fuel injector includes a body, a valve seat, a closure member, an orifice plate, and a metering device. The body has an inlet, an outlet, and a longitudinal axis entering therethrough. The valve seat is disposed proximate the outlet and has a first surface and a second surface. The valve seat includes a valve seat orifice disposed between the first and second surfaces. The closure member is movable along the longitudinal axis between a first position occluding fuel flow and a second position permitting fuel flow through the valve seat orifice. The closure member and the valve seat define a sealing surface in the first position of the closure member. The sealing surface is located on a virtual circle that defines a sealing diameter. The orifice plate is disposed proximate the outlet and has a third surface and a fourth surface. The orifice plate includes at least one orifice disposed between the third and fourth surfaces. The at least one orifice is located on a virtual circle on the orifice plate that defines a first diameter. The metering device is located between the valve seat and the orifice plate. The metering device has a first face and a second face contiguous to a third face. At least one of the first and third faces are spaced from one of the first and second surfaces of the valve seat to define a plurality of passages. Each passage has an inlet to the passage and an outlet from the passage. The outlet of each passage is located on a virtual circle that defines a second diameter greater than at least one of the first diameter and the sealing diameter.

The present invention also provides a flow diverter for a fuel injector that tends to reduce flow vortices and maintain spray stability. In another preferred embodiment of the invention, the flow diverter includes a valve seat, an orifice plate, and an insert. The valve seat is disposed along a longitudinal axis and has a first surface and a second surface. The valve seat further includes a valve seat orifice located between the first surface and the second surface and defines an orifice diameter with respect to the longitudinal axis. The orifice plate is disposed on the longitudinal axis and has at least two orifices. Each orifice of the at least two orifices are located at a first diameter from the other orifice. The insert is disposed along the longitudinal axis between the valve seat and the orifice plate. The insert has an annular portion coupled to a main portion, which protrudes into the valve seat orifice. The main portion has a first face spaced from one of the first and second surfaces of the valve seat to define at least two passageways. Each of the at least two passageways are contiguous to at least one virtual circle defining a second diameter. The second diameter is greater than the first diameter.

The present invention further provides a method of directing the flow of a fuel injector that maintains spray stability of the fuel exiting the fuel injector. In one preferred embodiment, the fuel injector has a body with a first end and a second end disposed along a longitudinal axis. A valve seat is disposed proximate the second end and has a first surface and a second surface, the second surface disposed about the longitudinal axis to define a valve seat orifice. A closure member movable along the longitudinal axis between a first position blocking fuel flow through the valve seat and a second position permitting fuel flow through the valve seat, the closure member defining, in the first position, a sealing diameter on the first surface of the valve seat. An orifice plate located proximate the second end, the orifice plate having at least two orifices located on a virtual circle defining a first diameter, and a metering device having an annular portion coupled to a main portion, the main portion having a first face and a second face, the first face projecting into the valve seat orifice and being spaced from the second surface of the valve seat to define at least one passage between the main portion and the second surface of the valve seat. In the preferred embodiment, the method can be achieved by directing fuel through the at least one passageway having a portion disposed on a virtual circle defining a second diameter greater than at least one of the first diameter and the sealing diameter; causing the fuel to flow towards the longitudinal axis; and diverting the fuel through the at least one orifice of the orifice plate.

BRIEF DESCRIPTION OF THE DRAWINGS

The accompanying drawings, which are incorporated herein and constitute part of this specification, illustrate presently preferred embodiments of the invention, and together with the general description given above and the detailed description given below, serve to explain the features of the invention.

DETAILED DESCRIPTION OF THE PREFERRED EMBODIMENTS

Figure 1A:
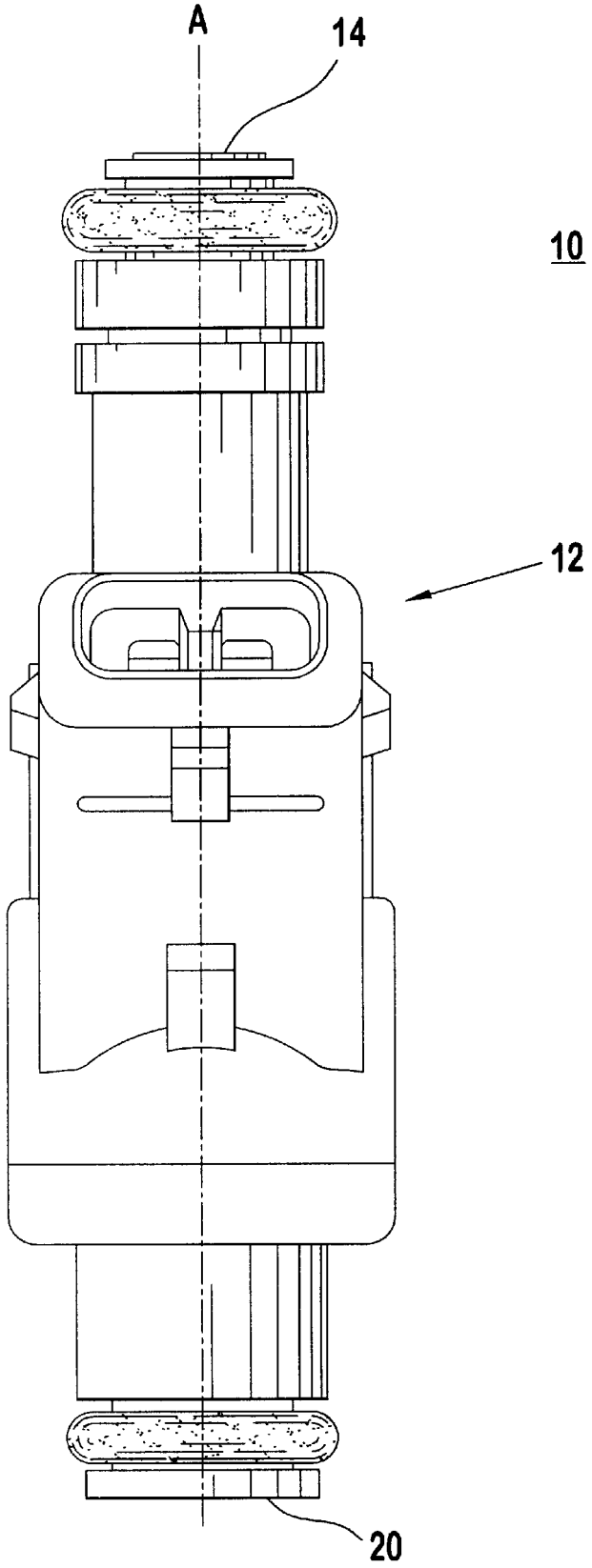
FIG. 1A is a side view of a fuel injector according to a preferred embodiment.
Figure 1B:
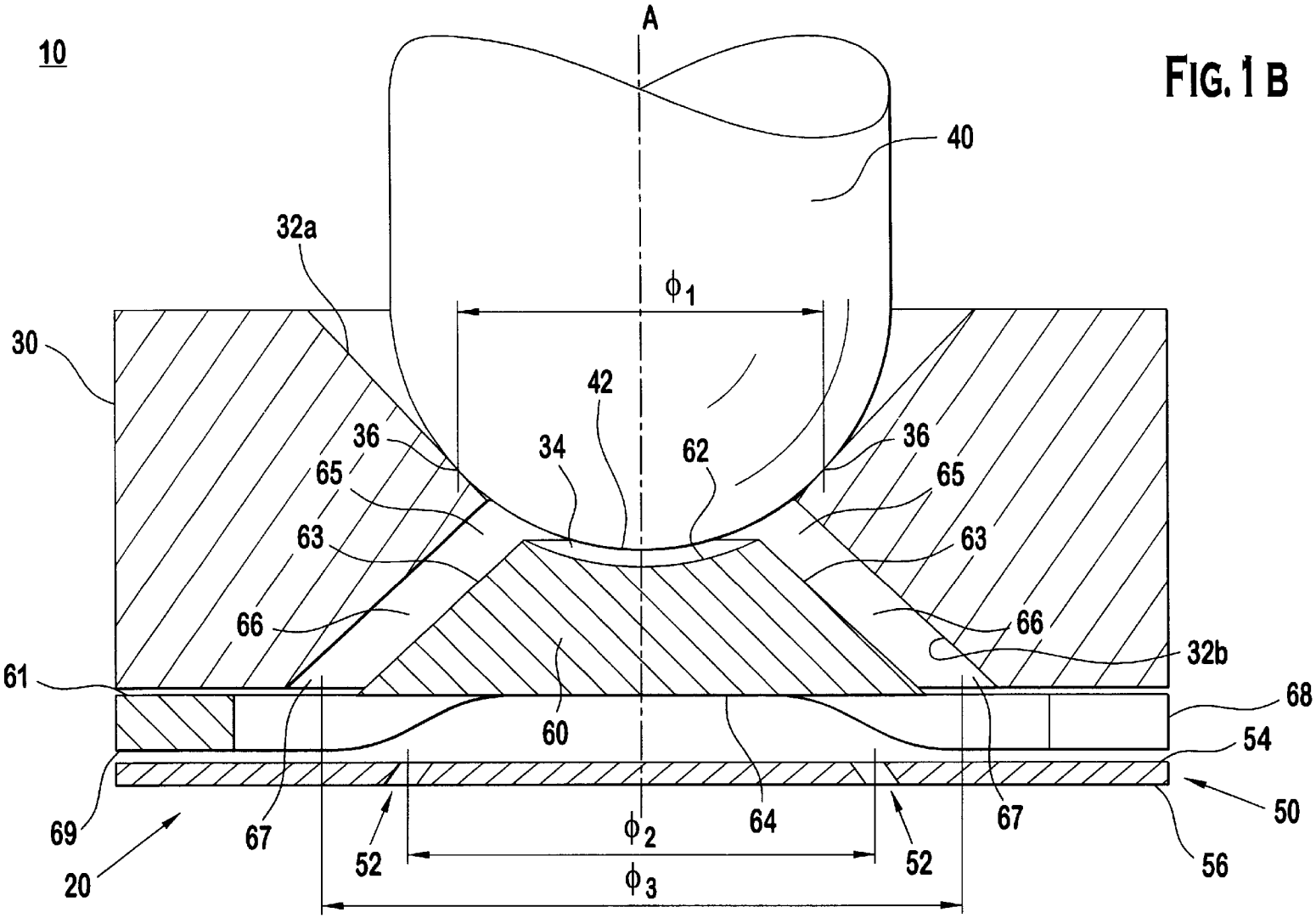
FIG. 1B is a side view, in enlarged cross-section, of the valve seat, closure member, insert, and orifice plate of FIG. 1A.

FIG. 1A illustrates a side view of a fuel injector 10 according to a preferred embodiment. The fuel injector 10 includes a body 12, through which a longitudinal axis A extends. An inlet 14 and an outlet 20 are disposed in the body 12 along the longitudinal axis A. A fuel injector of the type with which the preferred embodiments can be used is shown in U.S. Pat. No. 5,494,225 issued on Feb. 27, 1996, which is incorporated in its entirety herein by reference. Referring to FIG. 1B, a valve seat 30 is disposed proximate the outlet 20. The valve seat 30 includes a valve seat orifice 34. The valve seat 30 includes a first seat surface 32*a*, which slope radially inwardly and downwardly toward the valve seat orifice 34, which is oblique to the longitudinal axis A. The valve seat 30 also includes a second seat surface 32*b* whose surface defines a valve seat orifice 34. The terms "inwardly" and "outwardly" refer to directions toward and away from, respectively, the longitudinal axis A. The valve seat orifice 34 is disposed between the first and second seat surfaces 32*a*, 32*b* of the valve seat 30.

Figure 2:
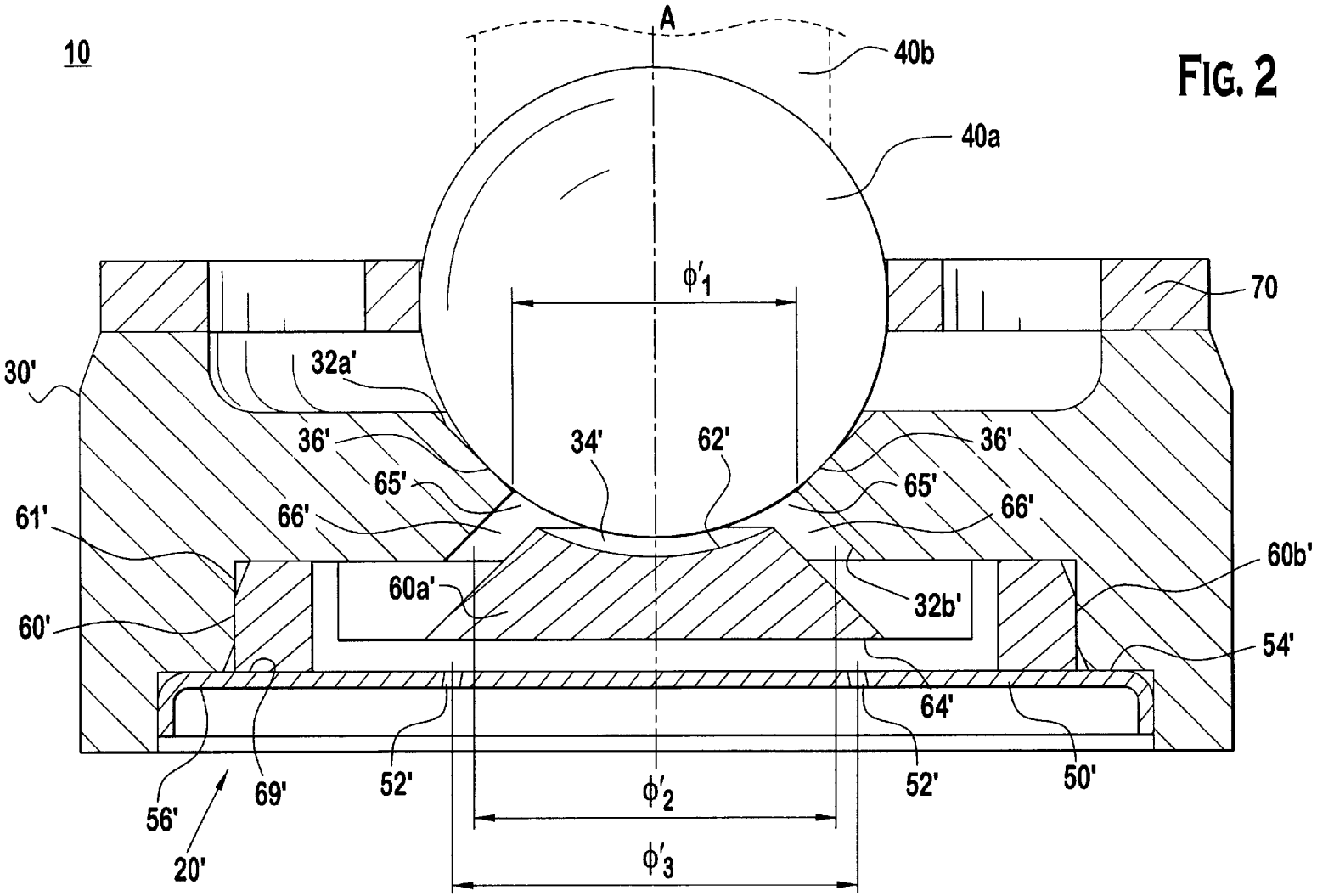
FIG. 2 is a side view of an alternative assembly of FIG. 1B.

A closure member 40 is disposed along the longitudinal axis A, and is movable along a plurality of positions. The closure member 40 includes a generally spherical tip 42, and the closure member 40 can be a needle-type, as shown in FIG. 1B or the closure member 40*a* may be a ball-type assembly, as shown in FIG. 2. The plurality of positions include an open position, (not shown) and a closed position, as shown in FIG. 1B and FIG. 2. In the closed position, the spherical tip 42 contacts a portion of the valve seat 30, thus defining a sealing surface 36. The sealing surface 36 is located on a virtual circle that defines a sealing diameter $\phi_1$ about the longitudinal axis A. In the closed position, the closure member 40 occludes fuel flow through the valve seat 30. In the open position, the spherical tip 42 does not contact the sealing surface 36, and thus the closure member 40 permits flow through the valve seat 30.

An orifice plate 50 is disposed proximate the outlet 20 downstream of the valve seat 30. The orifice plate 50 has a proximate surface 54 and a distal surface 56. As used with respect to the orifice plate 50, the terms "proximate" and "distal" refer to a position with respect to the inlet 14. The orifice plate 50 has at least one exit orifice 52 disposed between the proximate and distal surfaces of the orifice plate 50. The at least one exit orifice 52 is located on a virtual circle that defines an exit diameter $\phi_2$ about the longitudinal axis A.

A metering device 60 is located between the valve seat 30 and the orifice plate 50. The metering device 60 has a proximate face 62, which confronts the valve seat 30 and a distal face 64, which confronts the orifice plate 50. An intermediate face 63 is contiguous with the distal face 64. A surface of revolution of the intermediate face 63 of the metering device can form a portion of a cone. At least one of the proximate and intermediate faces 62,63 are spaced from one of the first and second surfaces 32*a*, 32*b* of the valve seat 30 to define a plurality of passageways 66. The valve seat 30 can be formed as an integral part of the metering device 60. Preferably, the proximate face 62 protrudes into the valve seat orifice 34. The proximate face 62 can have a substantially concave surface. The proximate face 62 can have a curvature other than concave or can be substantially flat. Preferably, the proximate face 62 has a concave surface. The proximate face 62 and the distal face 64 are in fluid communication by the plurality of passageways 66. The plurality of passageways 66 are radially spaced from the longitudinal axis A and preferably, are generally oblique with respect to the longitudinal axis A. Each of the plurality of passageways 66 has an inlet 65 to the passageway 66 and an outlet 67 from the passageway 66. The outlet 67 of each passageway 66 is located on a virtual circle that defines a passageway diameter $\phi_3$ about the longitudinal axis A, which is greater than at least one of the exit diameter $\phi_2$ and the sealing diameter $\phi_1$.

The metering device 60 can include a wall portion 68, which extends along the longitudinal axis A. The wall portion 68 can have at least two wall surfaces intersecting each other, a proximate wall surface 61 and a distal wall surface 69. As used with respect to the wall portion 68, the terms "proximate" and "distal" refer to a position with respect to the inlet 14. The proximate wall surface 61 and the distal wall surface 69 can cooperate with the second surface 32*b* of the valve seat and the proximate surface 54 of the orifice plate to define a cavity between the valve seat 30 and the orifice plate 50. The cavity can be in fluid communication with the plurality of passageways 66 and at least one of the plurality of exit orifices 52. The proximate face 62 of the metering device 60 can extend beyond a surface of revolution generated by the proximate and distal wall surfaces 61,69 of the wall portion 68. The distal face 64 of the metering device 60 can be contiguous to the surface of revolution generated by the proximate and distal wall surfaces 61,69 of the wall portion 68.

When the closure member 40 is in the open position, the spherical tip 42 is raised above and separated from the sealing surface 36, forming an annular opening therebetween, allowing pressurized fuel to flow therethrough and through the plurality of passageways 66 to an intake manifold and therefrom to a combustion chamber (not shown) for combustion. Upon moving the closure member 40 to the closed position, the spherical tip 42 engages the sealing surface 36, thus occluding the flow of fuel to the combustion chamber (not shown).

Figure 3:
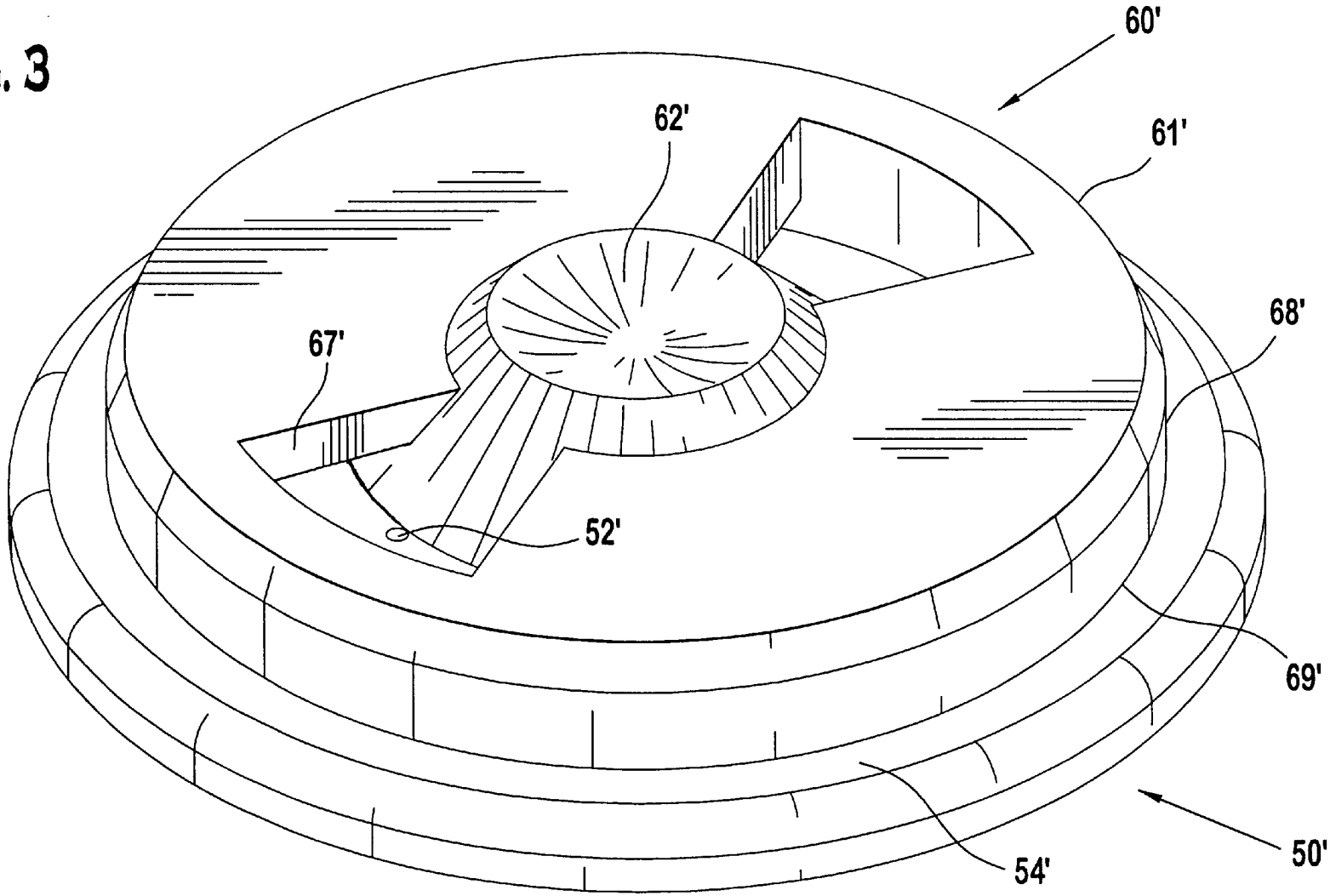
FIG. 3 is an orthogonal view of the metering device of FIG. 2.
Figure 4:
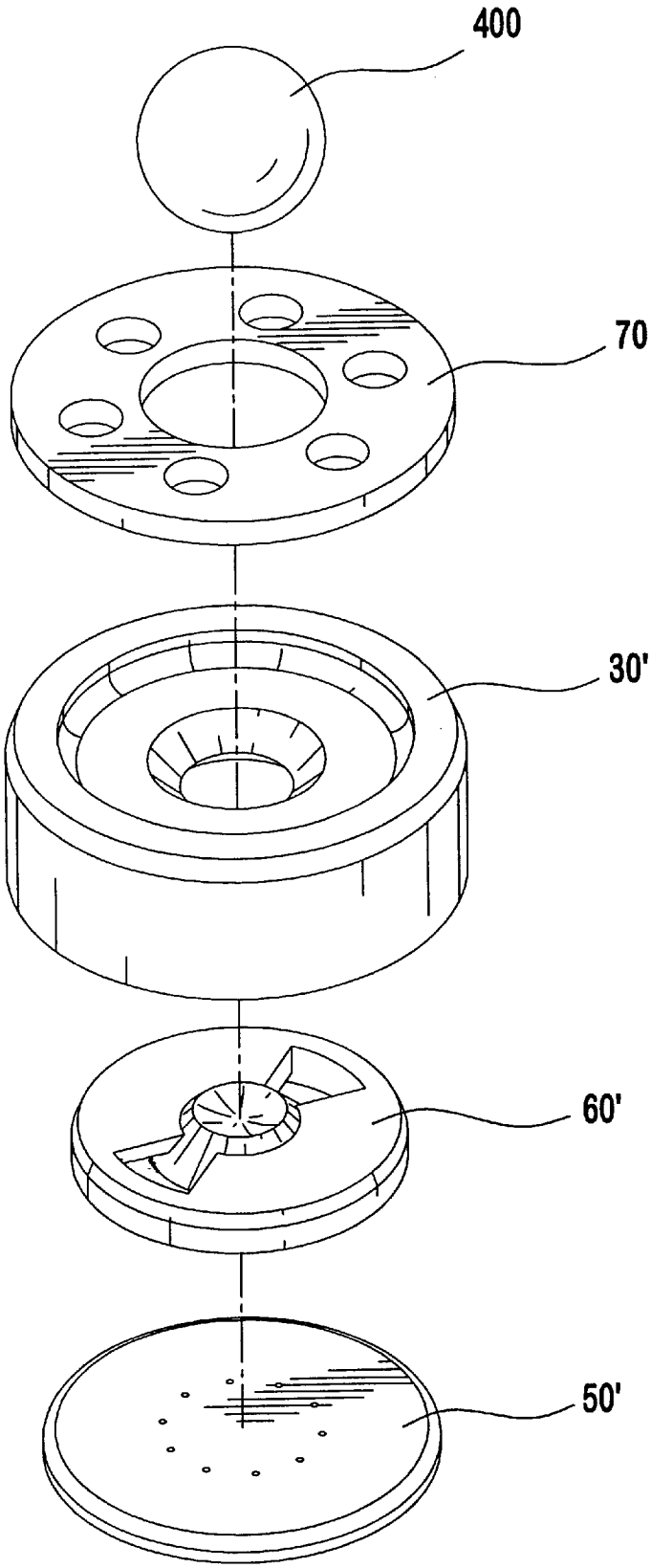
FIG. 4 is an exploded view of the valve seat, metering device, and orifice plate of FIG. 2.

Another embodiment of the present invention is illustrated in FIGS. 2–4. Like numerals in FIGS. 2–4 are used to indicate like elements. Referring to FIG. 2, a valve seat 30' is disposed proximate the outlet 20'. The valve seat 30' includes a valve seat orifice 34'. The valve seat 30' includes first and second seat surfaces 32*a*', 32*b*', which slope radially inwardly and downwardly toward the valve seat orifice 34', which is oblique to the longitudinal axis A. The terms "inwardly" and "outwardly" refer to directions toward and away from, respectively, the longitudinal axis A. The valve seat orifice 34' is disposed between the seat surfaces 32*a*', 32*b*' of the valve seat 30'.

A closure member 40*a* is disposed along the longitudinal axis A, and is movable along a plurality of positions. The closure member 40*a* can be a ball-type assembly. The plurality of positions include an open position, (not shown) and a closed position, as shown in FIG. 2. In the closed position, the closure member 40*a* contacts a portion of the valve seat 30' against the valve seat surface 32*a*', thus defining a sealing surface 36'. The sealing surface 36, is located on a virtual circle that defines a sealing diameter $\phi_1$' about the longitudinal axis A. In the closed position, the closure member 40*a* occludes fuel flow through the valve seat 30'. In the open position, the closure member 40*a* does not contact the sealing surface 36', and thus the closure member 40*a* permits flow through the valve seat 30'. A closure member guide 70 is disposed upstream of the valve seat 30'. The closure member guide 70 permits the closure member 40*a* to move along the plurality of positions but restricts movement of the closure member 40*a* in a lateral direction, i.e., in a direction substantially transverse to the longitudinal axis A.

An orifice plate 50' is disposed proximate the outlet 20' downstream of the valve seat 30'. The orifice plate 50' has a proximate surface 54' and a distal surface 56'. As used with respect to the orifice plate 50', the terms "proximate" and "distal" refer to a position with respect to the inlet 14. The orifice plate 50' has at least two exit orifices 52' disposed between the proximate and distal surfaces of the orifice plate 50'. The at least two exit orifices 52' are located on a virtual circle that defines an exit diameter $\phi_2$' about the longitudinal axis A.

A metering device 60' is disposed along the longitudinal axis A between the valve seat 30' and the orifice plate 50'. The metering device 60' has a main portion 60'*a* and an annular portion 60'*b* coupled to the main portion 60'*a*. The main portion 60'*a* protrudes into the valve seat orifice 34'. The main portion 60'*a* has a proximate face 62', which is spaced from one of the first and second seat surfaces 32*a*' and 32*b*' defining at least two passageways 66. Each of the at least two passageways 66 is contiguous to at least one virtual circle defining a passageway diameter $\phi_3$' about the longitudinal axis A, which is greater than the sealing diameter $\phi_1$'. The proximate face 62' confronts the valve seat 30', and a distal face 64' confronts the orifice plate 50'. An intermediate face 63' is contiguous with the distal face 64'. A surface of revolution of the intermediate face 63' of the metering device can form a portion of a cone. At least one of the proximate and intermediate faces 62', 63' are spaced from one of the first and second seat surfaces 32*a*', 32*b*' of the valve seat 30' to define a plurality of passageways 66'. The valve seat 30' can be formed as an integral part of the metering device 60'. The proximate face 62' protrudes into the valve seat orifice 34'. The proximate face 62' can have a substantially concave surface. The proximate face 62' can have a curvature other than concave or can be substantially flat. Preferably, the proximate face 62' has a concave surface. The proximate face 62' and the distal face 64' are in fluid communication by the plurality of passageways 66'. The plurality of passageways 66' are radially spaced from the longitudinal axis A and preferably, are generally oblique with respect to the longitudinal axis A. The metering device 60' can include at least one boss portion coupling the annular portion 60'*b* to the main portion 60'*a* to define at least one arcuate opening 67'. Each of the plurality of passageways 66' has an inlet 65' to the passageway 66' and a cavity between the valve seat 30' and the orifice plate 50'. The cavity is formed by the at least one arcuate opening 67'. The cavity can be in fluid communication with the plurality of passageways 66' and the at least two orifices 52'.

The metering device 60' can include a wall portion 68', which extends along the longitudinal axis A. The wall portion 68' can have at least two wall surfaces intersecting each other, a proximate wall surface 61' and a distal wall surface 69'. As used with respect to the wall portion 68', the terms "proximate" and "distal" refer to a position with respect to the inlet 14. The proximate wall surface 61' and the distal wall surface 69' can cooperate with the surfaces 32*a*', 32*b*' of the valve seat and the proximate surface 54' of the orifice plate to define a cavity between the valve seat 30' and the orifice plate 50'. The proximate face 62' of the metering device 60' can extend beyond a surface of revolution generated by the proximate and distal wall surfaces 61', 69' of the wall portion 68'. The distal face 64' of the metering device 60' can be disposed within a surface of revolution generated by the at least two wall surfaces 61', 69' of the wall portion 68'. Additionally, the distal face 64' extends into the valve seat orifice 34' that is defined by the second valve seat surface 32*b*'. Preferably, the distal face 64' is in a confronting arrangement with the second surface 32*b*' such that at least one passage is formed therebetween.

When the closure member 40*a* is in the open position, the ball assembly is raised above and separated from the sealing surface 36, forming an annular opening therebetween, allowing pressurized fuel to flow therethrough and through the plurality of passageways 66' to a combustion chamber (not shown) for combustion. Upon moving the closure member 40*a* to the closed position, the ball assembly engages the sealing surface 36', thus occluding the flow of fuel to the combustion chamber (not shown).

The operation of the fuel injector 10 is as follows. Like numerals are used to indicate like elements in the drawings. A fuel pump (not shown) provides pressurized fuel flow into the fuel injector 10. The pressurized fuel enters the fuel injector 10 and passes through a fuel filter (not shown) to an armature (not shown) and to a valve body chamber (not shown). The fuel flows through the valve body chamber (not shown) and to an interface between the spherical tip 42 of the closure member 40 and the sealing surface 36. In the closed position, shown in FIG. 1B and FIG. 2, the closure member 40 is biased against the valve seat 30 so that the spherical tip 42 sealingly engages the sealing surface 36, preventing flow of fuel through the valve seat orifice 34.

In the open position (not shown), a solenoid or other actuating device (not shown), reciprocates the closure member 40 thereby removing the spherical tip 42 of the closure member 40 from the sealing surface 36 of the valve seat 30. Pressurized fuel flows past the closure member 40 and into the plurality of passageways 66. The fuel is atomized as it passes through the plurality of exit orifices 52 to the combustion chamber (not shown) for combustion, allowing for better combustion within the combustion chamber (not shown).

When a predetermined amount of fuel has been injected into the combustion chamber (not shown), the solenoid or other actuating device (not shown) disengages, allowing the spring (not shown) to bias the closure member 40 to the first position onto the sealing surface 36, thus occluding flow through the valve seat 30.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel injector for use in a fuel injection system of an internal combustion engine, the fuel injector comprising:

a body having an inlet, an outlet and a longitudinal axis entering therethrough;

a valve seat disposed proximate the outlet, the valve seat having a first surface and a second surface, the valve seat including a valve seat orifice disposed between the first surface and the second surface;

a closure member movable along the longitudinal axis between a first position occluding fuel flow and a second position permitting fuel flow through the valve seat orifice, the closure member and the valve seat defining a sealing surface in the first position of the closure member, the sealing surface located on a virtual circle that defines a sealing diameter;

an orifice plate proximate the outlet, the orifice plate having a third surface and a fourth surface, the orifice plate including at least one orifice disposed between the third and fourth surfaces, the at least one orifice located on a virtual circle on the orifice plate that defines a first diameter; and a metering device located between the valve seat and the orifice plate, the metering device having a first face and a second face contiguous to a third face, at least one of the first and third faces being spaced from one of the first and second surfaces of the valve seat to define a plurality of passages, each passage having an inlet to the passage and an outlet from the passage, the outlet of each passage being located on a virtual circle that defines a second diameter greater than each of the first diameter and the sealing diameter.

2. The fuel injector according to claim 1, wherein the first face of the metering device protrudes into the valve seat orifice.

3. The fuel injector according to claim 2, wherein the first face of the metering device has a concave surface.

4. The fuel injector according to claim 1, wherein the plurality of passages comprises a plurality of passages orientated generally oblique with respect to the longitudinal axis.

5. A fuel injector for use in a fuel injection system of an internal combustion engine, the fuel injector comprising:

a body having an inlet, an outlet and a longitudinal axis entering therethrough;

a valve seat disposed proximate the outlet, the valve seat having a first surface and a second surface, the valve seat including a valve seat orifice disposed between the first surface and the second surface;

a closure member movable along the longitudinal axis between a first position occluding fuel flow and a second position permitting fuel flow through the valve seat orifice, the closure member and the valve seat defining a sealing surface in the first position of the closure member, the sealing surface located on a virtual circle that defines a sealing diameter;

an orifice plate proximate the outlet, the orifice plate having a third surface and a fourth surface, the orifice plate including at least one orifice disposed between the third and fourth surfaces, the at least one orifice located on a virtual circle on the orifice plate that defines a first diameter; and a metering device located between the valve seat and the orifice plate, the metering device having a first face and a second face contiguous to a third face, at least one of the first and third faces being spaced from one of the first and second surfaces of the valve seat to define a plurality of passages, each passage having an inlet to the passage and an outlet from the passage, the outlet of each passage being located on a virtual circle that defines a second diameter greater than at least one of the first diameter and the sealing diameter, wherein the valve seat is formed as a part of the metering device.

6. The fuel injector according to claim 1, wherein the metering device includes a wall portion extending along the longitudinal axis, the wall portion having at least two wall surfaces intersecting each other, the at least two wall surfaces cooperating with the second surface of the valve seat and the third surface of the orifice plate to define a cavity between the valve seat and the orifice plate.

7. The fuel injector according to claim 6, wherein the cavity is in fluid communication with the plurality of passages and the at least one orifice.

8. The fuel injector according to claim 6, wherein the first face of the metering device extends beyond a surface of revolution generated by the at least two wall surfaces of the wall portion.

9. The fuel injector according to claim 8, wherein the second face of the metering device is contiguous to the surface of revolution generated by the at least two wall surfaces of the wall portion.

10. The fuel injector according to claim 8, wherein the second face of the metering device is disposed within the surface of revolution generated by the at least two wall surfaces of the wall portion.

11. A fuel injector, for use in a fuel injection system of an internal combustion engine, the fuel injector comprising:

a body having an inlet, an outlet and a longitudinal axis entering therethrough;

a valve seat disposed proximate the outlet, the valve seat having a first surface and a second surface, the valve seat including a valve seat orifice disposed between the first surface and the second surface;

a closure member movable along the longitudinal axis between a first position occluding fuel flow and a second position permitting fuel flow through the valve seat orifice, the closure member and the valve seat defining a sealing surface in the first position of the closure member, the sealing surface located on a virtual circle that defines a sealing diameter;

an orifice plate proximate the outlet, the orifice plate having a third surface and a fourth surface, the orifice plate including at least one orifice disposed between the third and fourth surfaces, the at least one orifice located on a virtual circle on the orifice plate that defines a first diameter; and a metering device located between the valve seat and the orifice plate, the metering device having a first face and a second face contiguous to a third face, at least one of the first and third faces being spaced from one of the first and second surfaces of the valve seat to define a plurality of passages, each passage having an inlet to the passage and an outlet from the passage, the outlet of each passage being located on a virtual circle that defines a second diameter greater than at least one of the first diameter and the sealing diameter, the metering device including a wall portion extending along the longitudinal axis, the wall portion having at least two wall surfaces intersecting each other, the at least two wall surfaces cooperating with the second surface of the valve seat and the third surface of the orifice plate to define a cavity between the valve seat and the orifice plate and a surface of revolution of the third face of the metering device forms a portion of a cone.

12. A flow diverter for a fuel injector, the flow diverter comprising:

a valve seat disposed along a longitudinal axis, the valve seat having a first surface and a second surface, the valve seat further including a valve seat orifice located between the first surface and the second surface and defining an orifice diameter with respect to the longitudinal axis;

an orifice plate disposed on the longitudinal axis, the orifice plate having at least two orifices, each orifice of the at least two orifices being located at a first diameter from the other orifice; and an insert disposed along the longitudinal axis between the valve seat and the orifice plate, the insert having an annular portion coupled to a main portion, the main portion protruding into the valve seat orifice, the main portion having a first face spaced from one of the first and second surfaces of the valve seat to define at least two passageways, each of the at least two passageways being contiguous to at least one virtual circle defining a second diameter, the second diameter being greater than the first diameter, the insert including at least one boss portion coupling the annular portion to the main portion to define at least one arcuate opening.

13. The flow diverter according to claim 12 wherein the second surface of the valve seat is contiguous to the annular portion and the at least one arcuate opening to form a cavity between the valve seat and the orifice plate.

14. The flow diverter according to claim 13 herein the at least two orifices are in fluid communication with the cavity.

15. A method of maintaining spray stability in fuel flow of a fuel injector, the fuel injector having a body with a first end and a second end disposed along a longitudinal axis, a valve seat disposed proximate the second end, the valve seat having a first surface and a second surface, the second surface disposed about the longitudinal axis to define a valve seat orifice, a closure member movable along the longitudinal axis between a first position blocking fuel flow through the valve seat and a second position permitting fuel flow through the valve seat, the closure member defining, in the first position, a sealing diameter on the first surface of the valve seat, an orifice plate located proximate the second end, the orifice plate having at least two orifices located on a virtual circle defining a first diameter, and a metering device having an annular portion coupled to a main portion, the main portion having a first face and a second face, the first face projecting into the valve seat orifice and being spaced from the second surface of the valve seat to define at least one passage between the main portion and the second surface of the valve seat, the method comprising:

directing fuel through the at least one passage having a portion disposed on a virtual circle defining a second diameter greater than at least one of the first diameter and the sealing diameter, and directing the fuel towards at least one arcuate opening formed between the main portion and the annular portion;

causing the fuel to flow towards the longitudinal axis; and diverting the fuel through the at least one orifice of the orifice plate.

16. The method of claim 15, wherein the arcuate opening comprises at least one boss portion coupling the main portion and the annular portion.

17. The method of claim 15, wherein the causing further comprises providing a cavity between the valve seat and the orifice plate that permits fuel to flow towards the longitudinal axis.

18. The method of claim 15, wherein causing comprises causing fuel to flow in a direction oblique to the longitudinal axis.

19. The method of claim 15, wherein the causing comprises causing fuel to flow in a direction transverse to the longitudinal axis.

20. The method of claim 15, wherein the diverting further comprises flowing fuel in a direction oblique to the longitudinal axis.

21. The method of claim 16, wherein the diverting comprises flowing fuel in a direction diverging from the longitudinal axis.

22. The method of claim 16, wherein the diverting comprises flowing fuel in a direction converging towards the longitudinal axis.

23. The method of claim 22, wherein the cavity is formed by a wall portion of the annular portion that is contiguous to the second surface of the valve seat, and also contiguous to a surface of the orifice plate.

* * * * *